US010836162B2

(12) United States Patent
Cumbie et al.

(10) Patent No.: US 10,836,162 B2
(45) Date of Patent: Nov. 17, 2020

(54) PRINT HEAD INTERPOSERS

(71) Applicant: HEWLETT-PACKARD DEVELOPMENT COMPANY, L.P., Spring, TX (US)

(72) Inventors: Michael W. Cumbie, Corvallis, OR (US); Devin Alexander Mourey, Corvallis, OR (US); Chien-Hua Chen, Escondido, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/244,663

(22) Filed: Jan. 10, 2019

(65) Prior Publication Data

US 2019/0143688 A1 May 16, 2019

Related U.S. Application Data

(63) Continuation of application No. 15/748,856, filed as application No. PCT/US2015/055704 on Oct. 15, 2015, now Pat. No. 10,207,500.

(51) Int. Cl.

| | |
|---|---|
| ***B41J 2/135*** | (2006.01) |
| ***B41J 2/14*** | (2006.01) |
| ***B41J 2/16*** | (2006.01) |
| ***B41J 2/175*** | (2006.01) |
| ***B41J 2/315*** | (2006.01) |

(52) U.S. Cl.

CPC ..... *B41J 2/14072* (2013.01); *B41J 2/135* (2013.01); *B41J 2/14088* (2013.01); *B41J 2/1601* (2013.01); *B41J 2/1623* (2013.01); *B41J 2/1637* (2013.01); *B41J 2/175* (2013.01); *B41J 2/315* (2013.01); *B41J 2202/01* (2013.01)

(58) Field of Classification Search

CPC ..... B41J 2/135; B41J 2/14088; B41J 2/1601; B41J 2/1623; B41J 2/1637; B41J 2/175; B41J 2/315; B41J 2/14072

See application file for complete search history.

(56) References Cited

U.S. PATENT DOCUMENTS

| | | | |
|---|---|---|---|
| 4,873,622 | A | 10/1989 | Komuro et al. |
| 6,123,410 | A | 9/2000 | Beerling et al. |

(Continued)

FOREIGN PATENT DOCUMENTS

| | | |
|---|---|---|
| CN | 1286167 | 3/2001 |
| CN | 1286169 | 3/2001 |

(Continued)

OTHER PUBLICATIONS

Boettcher et al.; "Embedding of Chips for System in Package realization—Technology and Applications"; CPA Patentability Search Report, http://www.izm.fraunhofer.de/content/dam/izm/de/documents/News-Events/News/2008-2001_Auszeichnungen/Paper_embedding_IMPACT_Lars_Boettcherv2_.pdf; Sep. 2008.

*Primary Examiner* — Lamson D Nguyen

(74) *Attorney, Agent, or Firm* — Trop, Pruner & Hu, P.C.

(57) ABSTRACT

In example implementations, an apparatus with an interposer is provided. The apparatus may include an epoxy molded compound (EMC). A print head die and a drive integrated circuit (IC) may be embedded in the EMC. An interposer may also be embedded in the EMC. The print head die, the drive IC and the interposer may be wire bonded within the EMC.

6 Claims, 5 Drawing Sheets

(56) References Cited

U.S. PATENT DOCUMENTS

| | | | |
|---|---|---|---|
| 6,188,414 | B1 | 2/2001 | Wong et al. |
| 6,641,254 | B1 | 11/2003 | Boucher et al. |
| 8,263,435 | B2 | 9/2012 | Choi et al. |
| 8,580,683 | B2 | 11/2013 | Wang et al. |
| 8,590,156 | B2 | 11/2013 | Murray |
| 9,656,469 | B2 | 5/2017 | Chen et al. |
| 9,751,319 | B2 | 9/2017 | Chen et al. |
| 9,919,525 | B2 | 3/2018 | Chen et al. |
| 10,207,500 | B2 * | 2/2019 | Cumbie ..... B41J 2/1601 |
| 10,226,926 | B2 | 3/2019 | Chen et al. |
| 10,232,619 | B2 | 3/2019 | Chen et al. |
| 2003/0193545 | A1 | 10/2003 | Boucher et al. |
| 2008/0259125 | A1 | 10/2008 | Haluzak et al. |
| 2009/0079793 | A1 | 3/2009 | Shan et al. |
| 2010/0052087 | A1 | 3/2010 | McElrea et al. |
| 2011/0037808 | A1 | 2/2011 | Ciminelli et al. |
| 2015/0202871 | A1 | 7/2015 | Cruz-Uribe et al. |
| 2015/0239242 | A1 | 8/2015 | Mackenzie et al. |

FOREIGN PATENT DOCUMENTS

| | | |
|---|---|---|
| CN | 102781671 | 11/2012 |
| IL | 154337 | 9/2000 |
| WO | WO-2014028022 | 2/2014 |
| WO | WO-2014133516 | 9/2014 |
| WO | WO-2014133517 | 9/2014 |
| WO | WO-2014133561 | 9/2014 |
| WO | WO-2014133563 | 9/2014 |
| WO | WO-2014133575 | 9/2014 |
| WO | WO-2014133577 | 9/2014 |
| WO | WO-2014133578 | 9/2014 |
| WO | WO-2014133590 | 9/2014 |
| WO | WO-2014133600 | 9/2014 |
| WO | WO-2014133633 | 9/2014 |
| WO | WO-2014133660 | 9/2014 |
| WO | WO-2014153305 | 9/2014 |
| WO | WO-2014209506 | 12/2014 |
| WO | WO-2015041665 | 3/2015 |
| WO | WO-2015065320 | 5/2015 |
| WO | WO-2015080730 | 6/2015 |

* cited by examiner

100

PRINT HEAD INTERPOSERS

BACKGROUND

Ink jet printers use print heads that emit different colors of ink onto a medium in a desired pattern. Different color print head dies are deployed with separate electrical interconnects on each end of the dies. Currently used configurations of the print heads have the integrated circuits coupled externally to the molded print head.

DETAILED DESCRIPTION

The present disclosure broadly discloses a molded print head having an interposer. As discussed above, currently used configurations of molded print heads couple an ASIC or drive integrated circuit (IC) externally to the molded print head. However, this may use pads or interconnects at the end of the print head dies. Due to the challenge of locating the pads or interconnects, additional silicon may be required to form the print head dies. This may lead to additional costs associated with the increased consumption of silicon. In addition, the surface of the print head die may be uneven due to protruding wire bonds that couple the ASIC or drive IC that are external to the print head die.

Examples of the present disclosure use an interposer to allow the ASIC or the drive IC to be wire bonded to the print head dies internal to the molded print head. As a result, the additional silicon used for the pads or interconnects to connect to the ASIC or drive IC may be eliminated. In addition, by encapsulating the wire bonds, the print head may have a flat or planar surface.

Figure 1:
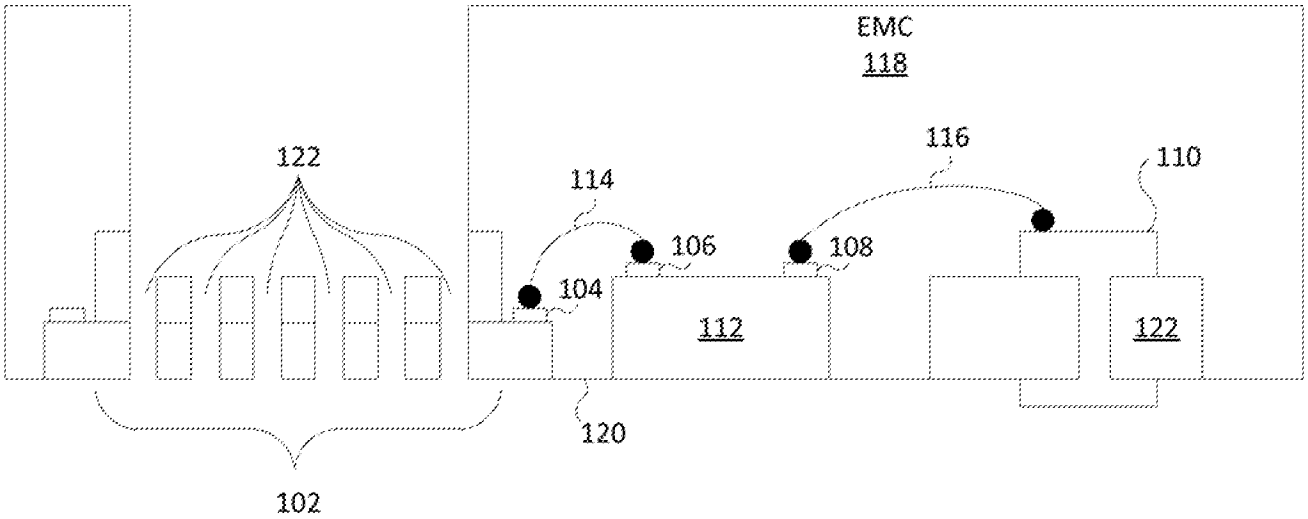
FIG. 1 is a block diagram of an example molded print head with an interposer of present disclosure.

FIG. 1 illustrates a block diagram of an example molded print head 100 with an interposer 110. FIG. 1 illustrates a cross-sectional view of the example molded print head 100.

In one example, the molded print head 100 includes a print head die 102, a drive integrated circuit (IC) 112 and the interposer 110. The print head die 102, the drive IC 112 and the interposer 110 may be encapsulated by an epoxy molded compound (EMC) 118. An example EMC may include compounds such as CEL400ZHF40WG from Hitachi® Chemical.

In one example, the print head die 102 may be a thermal fluid ejection die (e.g., the print head die 102 may be used in a variety of different types of two-dimensional and three-dimensional printers). The drive IC 112 may be a semiconductor microchip or processor that is used to control actuators (not shown) for each one of the ink feed holes 122 of the print head die 102. In one implementation the drive IC 112 may be an application specific integrated circuit (ASIC) that is customized to control the print head die 102 of the molded print head 100. As noted above, the drive IC 112 would previously be externally connected to the print head die 102.

In one implementation, the interposer 110 allows the drive IC 112 to be connected to the print head die 102 within the molded print head 100 and connected before the EMC 118 is applied. The interposer 110 may be a structure within the molded print head 100 that provides an electrical connection from one "z" plane to another "z" plane. Said another way, the interposer 110 may allow an electrical connection from within the molded print head 100 to a front side 120 of the molded print head 100.

The interposer 110 may allow the drive IC 112 to be located within the molded print head 100, instead of being connected to the print head die 102 externally. For example, the drive IC 112 may be connected to the print head die 102 via an electrical connection 114 that connects pads 104 and 106. The drive IC 112 may also be connected to the interposer 110 via an electrical connection 116 that connects a pad 108 to the interposer 110. In one example, the electrical connections 114 and 116 may be a wire bond. Then, the print head die 102, the drive IC 112 and the interposer 110 may be encapsulated by the EMC 118.

In addition, by connecting the drive IC 112 to the print head die 102 within the EMC 118, the use of additional silicon that was previously used to provide an area for pads and interconnects for the external connection is eliminated. Also by removing the external electrical connections between the drive IC 112 and the print head die 102, a flat or planar surface is crated on the molded print head 100. For example, the front surface 120 may be relatively flat.

In one example, the interposer 110 may be fabricated from a variety of different materials such as, a metal, conductors, semi-conductors (e.g., silicon, a ceramic, glass, and the like), a silver or carbon conductive particle-filled plastic or epoxy materials that fill a via through a material 122. Examples of different conductors, or semiconductors, and materials 122 that can be used may include silicon (Si) with a through silicon via (TSV), glass with a through glass via (TGV), a molded part with a through molded via (TMV), a printed circuit board (PCB) with a via filled with the material, and the like.

Figure 2:
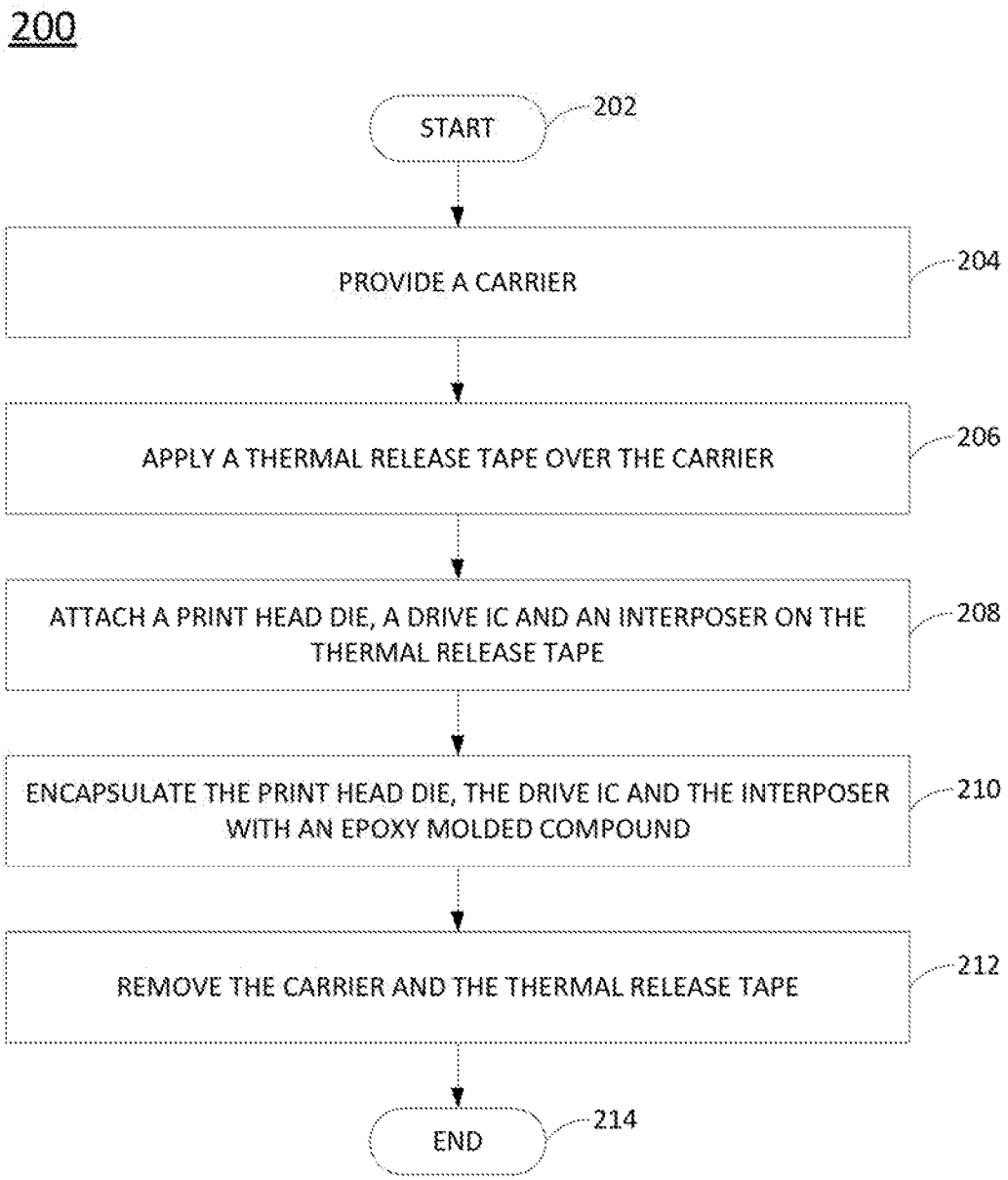
FIG. 2 is a flow diagram of an example method for manufacturing the molded print head with the interposer.
Figure 3:
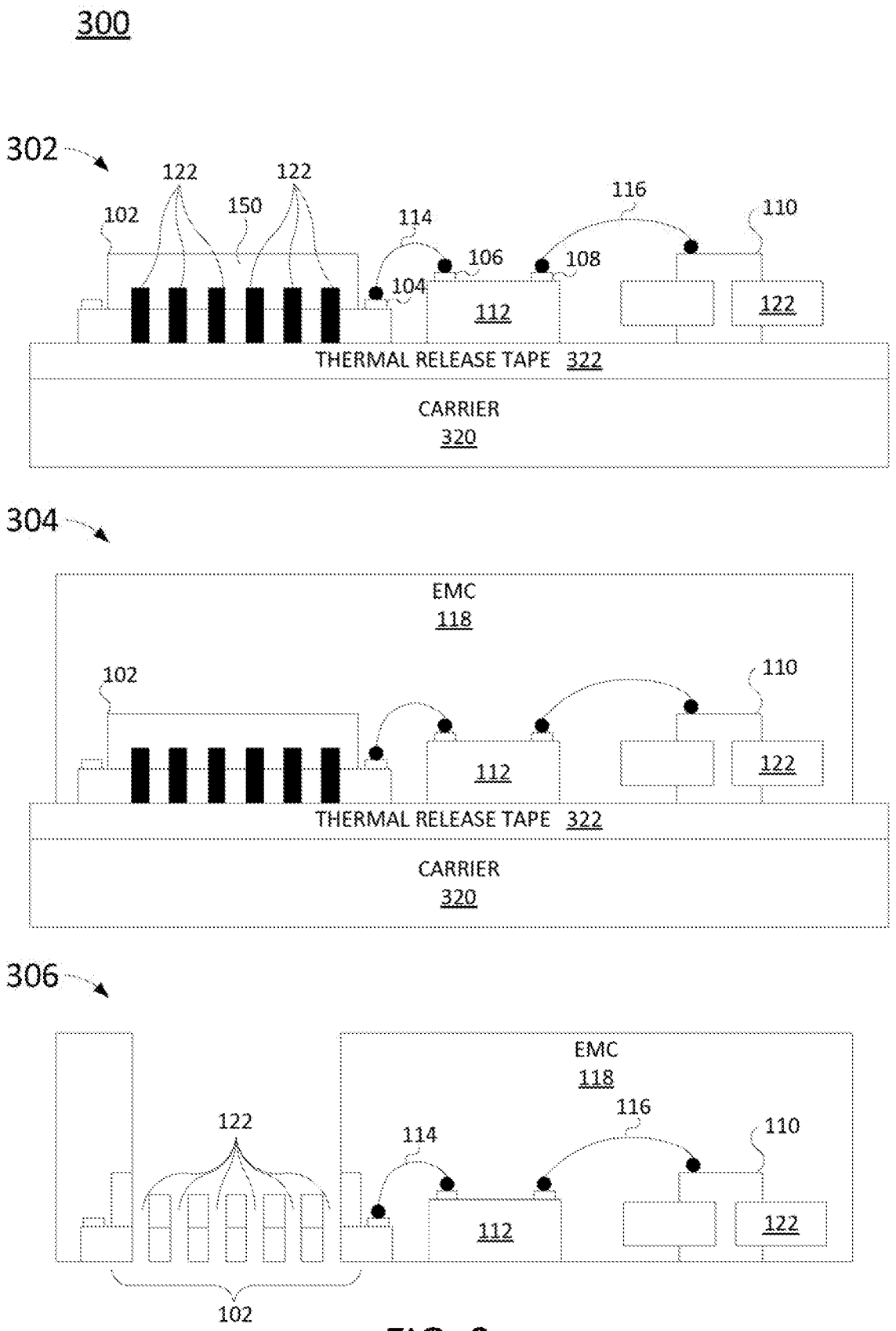
FIG. 3 is an example schematic diagram of a method for manufacturing the molded print head with the interposer.

FIG. 2 illustrates a flow diagram of an example method 200 for manufacturing the molded print head 100 with the interposer 110. The method 200 may be performed by a variety of different tools (e.g., a mold tool, a lithography tool, an etching tool, a polishing tool, and the like) within a fabrication plant. FIG. 3 illustrates an example schematic diagram of a method 300 for manufacturing the molded print head 100 with the interposer 110. It should be noted that FIG. 3 may be referred to in conjunction with the blocks of FIG. 2.

At block 202, the method 200 begins. At block 204, the method 200 provides a carrier. The carrier may be a printed circuit board (e.g., an FR4 PCB). The carrier provides a structure of foundation for the molded print head 100 to be formed.

At block 206, the method 200 applies a thermal release tape over the carrier. The thermal release tape may be any type of material that allows for adhesion of electrical components and removal via heating of the thermal release tape. The thermal release tape may be used to remove the structured carrier from the molded print head. An example of the thermal release tape that can be used may be product number 3195V from Nitto Denko®.

At block 208, the method 200 attaches a print head die, a drive IC and an interposer on the thermal release tape. FIG. 3 illustrates a diagram of the print head die 102, the drive IC 112 and the interposer 110 attached to a thermal release tape 322 and a carrier 320 at block 302. It should be noted that although only a single print head die 102, a single drive IC 112 and a single interposer 110 are illustrated in the block 302 of FIG. 3, that any number of print head dies 102, drive ICs 112 and interposers 110 may be attached to the thermal release tape 322. In addition, although one drive IC 112 is shown connected to one print head die 102, it should be noted that the drive IC 112 may be connected to a plurality of different print head dies 102.

FIG. 3 illustrates the print head die 102 protected by a top hat 150. The top hat 150 may protect the ink feed holes 122 from being clogged or collecting debris during fabrication of the molded print head 100. The top hat 150 may be an epoxy based chemically amplified negative photoresist material. The ink feed holes 122 may also be filled for protection.

Referring back to FIG. 2, at block 210, the method 200 encapsulates the print head die, the device IC and the interposer with an epoxy molded compound. In one example, the EMC may be applied using a compression mold tool. In one example, the compression mold tool may be from TOWA®. The EMC 118 may be applied at 140 degrees Celsius (° C.) for approximately 5 minutes. FIG. 3 at block 304 illustrates the EMC 118 encapsulating the print head die 102, the drive IC 112 and the interposer 110.

Referring back to FIG. 2, at block 212, the method 200 removes the carrier and the thermal release tape. FIG. 3 illustrates the molded print head 100 after the thermal release tape 322 and the carrier 320 are removed in block 306. In addition, patterning and etch steps may be applied to slot the EMC 118 over the print head die 102. The patterning and etch steps remove the top hat 150 and any material in the ink feed holes 122 to open up the ink feed holes 122. At block 214, the method 200 ends.

Figure 4A:
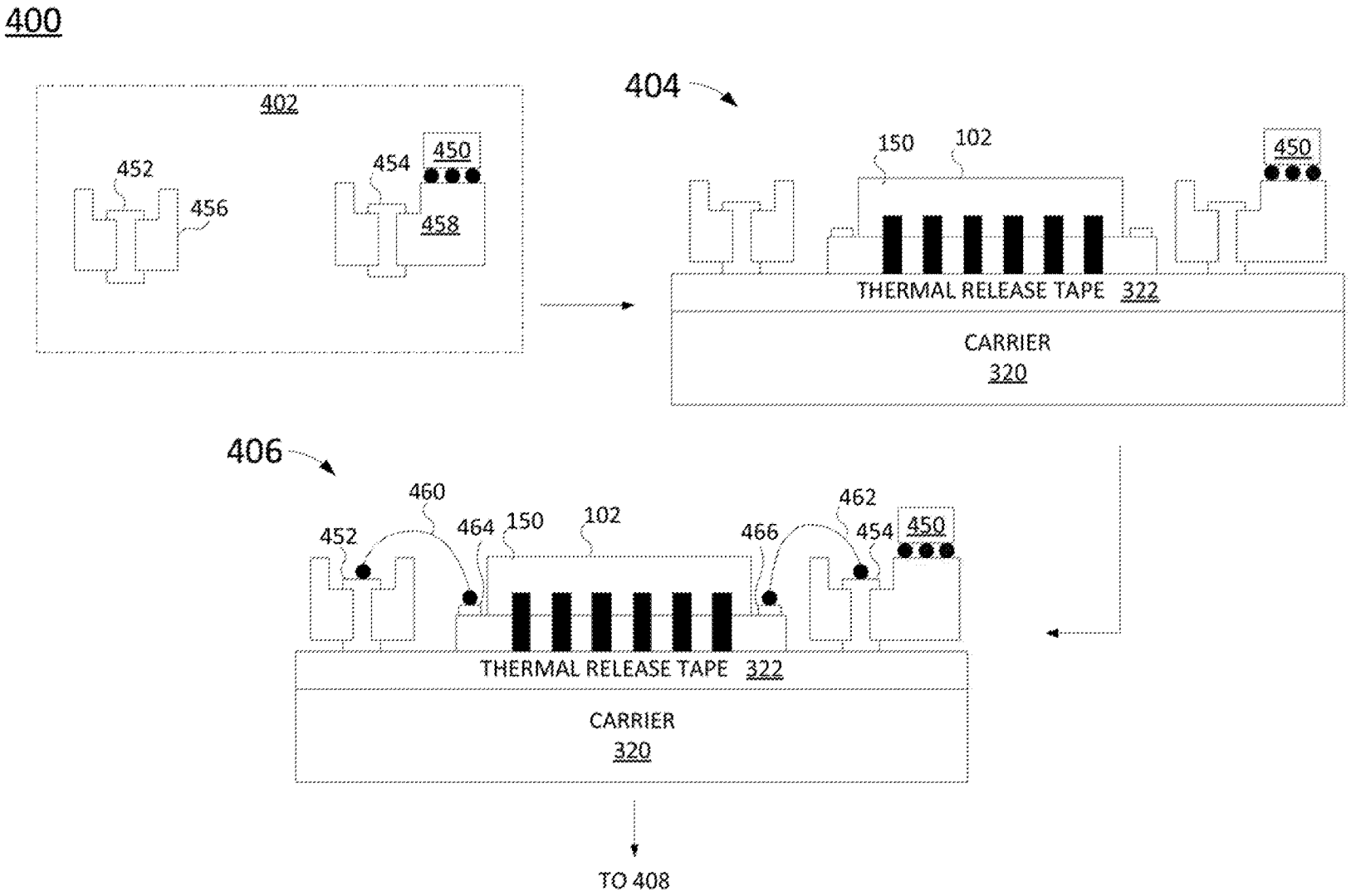
FIGS. 4A and 4B are a more detailed example schematic diagram of a method for manufacturing a molded print head with an interposer.
Figure 4:
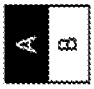
Figure 4B:
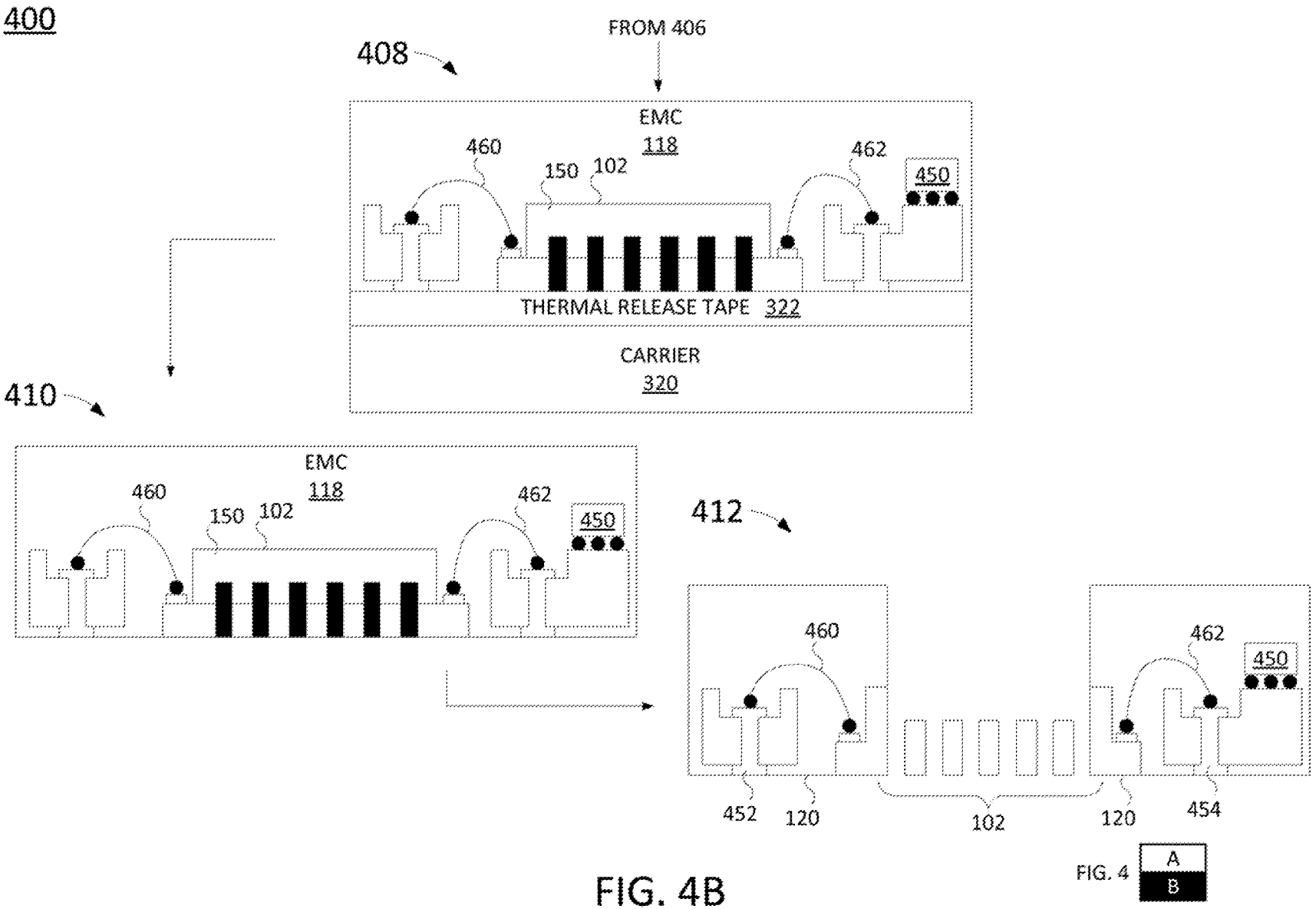

FIGS. 4A and 4B illustrate another example schematic diagram of a method 400 for manufacturing a molded print head with an interposer. Beginning in FIG. 4A at block 402, a PCB 456 with an interposer 452 and a PCB 458 with an interposer 454 may be prepared in advance. An ASIC 450 may be bonded to the PCB 458. The ASIC 450 may control the actuators (not shown) for the ink feed holes of the print head die 102, as described above.

At block 404, the PCB 456 with the interposer 452, the PCB 458 with the interposer 454, and the ASIC 450 may be attached to a thermal release tape 322. Although a single ASIC 450, two PCBs 456 and 458, and two interposers 452 and 454 are illustrated as being attached to the thermal release tape 322 in FIG. 4, it should be noted that any number of ASICs, PCBs and interposers may be attached to the thermal release tape 322. The thermal release tape 322 may be applied to a carrier 320. In addition, a print head die 102 may be attached to the thermal release tape 322.

The print head die 102 may be a thermal fluid ejection print head die. Although only a single print head die 102 is illustrated in FIG. 4, it should be noted that the any number of print head dies 102 may be attached to the thermal release tape 322. Similar to the print head die 102 in FIG. 3, the print head die 102 may have a top hat 150 that protects the ink feed holes from clogging or collecting debris during fabrication of the molded print head. The top hat 150 may be an epoxy based chemically amplified negative photoresist material. The ink feed holes may also be filled for protection.

At block 406, the print head die 102 may be connected to the interposer 452 via at least one electrical connection 460 and connected to the interposer 454 via at least one electrical connection 462. For example, the electrical connection 460 may connect the interposer 452 to a pad 464 of the print head die 102. The electrical connection 462 may connect the interposer 454 to a pad 466 of the print head die 102. In one implementation, the electrical connections 460 and 462 may be wire bonded via a conductive metal (e.g., a copper wire).

Continuing to FIG. 4B at block 408, the print head die 102, the PCB 456 with the interposer 452 and the PCB 458 with the interposer 454 and the ASIC 450 may be encapsulated. In one implementation an EMC 118 may be used to encapsulate the components on the thermal release tape 322. In one example, the compression mold tool may be from TOWA®. The EMC 118 may be applied at 140 degrees Celsius (° C.) for approximately 5 minutes.

At block 410, the thermal release tape 322 and the carrier 320 may be removed. For example, the thermal release tape 322 may be heated to remove it from the molded print head.

At block 412, a slot over an area in the EMC 118 that covers ink feed holes in the print head die 102 may be formed and a protective top hat 150 on the print head die 102 may be removed. In one example, the slot may be formed via a plunge cut sawing or laser ablation process. For example, the area in the EMC 118 that covers the ink feed holes may be patterned using laser ablation to remove the desired portion of the EMC 118. A subsequent etch step may be applied to the exposed top hat 150 to remove the top hat 150. The remaining components illustrated in block 412 illustrate the completed molded print head with interposers.

The molded print head may have a flat surface on a front side 120 of the molded print head. In addition, the interposers 452 and 454 allow the molded print head to be easily connected to other components or attached to a circuit board. In other words, the interposers 452 and 454 transfer at least one electric connection from within the EMC 118 to the front side (e.g., the front side 120) of the EMC. In addition, by encapsulating the ASIC 450 within the EMC 118, the molded print head may have a smaller footprint.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. An apparatus, comprising:

an epoxy molded compound (EMC), wherein the EMC comprises a slot formed through the EMC;

a print head die embedded in the EMC, wherein the print head die comprises ink feed holes formed in a back surface of the print head die, and the ink feed holes to be fluidically coupled to the slot;

a drive integrated circuit (IC) embedded in the EMC; and an interposer embedded in the EMC, wherein the print head die, the drive IC and the interposer are wire bonded within the EMC.

2. The apparatus of claim 1, wherein the print head die comprises a thermal fluid ejection molded print head.

3. The apparatus of claim 1, wherein the interposer transfers electrical connections from within the EMC to a front side of the EMC.

4. The apparatus of claim 1, wherein the interposer comprises a metal.

5. The apparatus of claim 1, wherein the interposer comprises a silver or carbon particle-filled plastic or an epoxy material.

6. The apparatus of claim 1, further comprising a plurality of print head dies embedded in the EMC, wherein the print head die comprising the ink feed holes is part of the plurality of print head dies, and the plurality of print head dies are associated with different colors.

* * * * *